US008757129B1

(12) United States Patent
Hill et al.

(10) Patent No.: US 8,757,129 B1
(45) Date of Patent: Jun. 24, 2014

(54) MULTI-FUEL PLASMA INJECTOR

(71) Applicant: Thrival Tech, LLC, Ashland, OR (US)

(72) Inventors: Garrett Hill, Ashland, OR (US); Scott Lazar, Ashland, OR (US); Dustin Stonehouse, Ashland, OR (US)

(73) Assignee: Thrival Tech, LLC, Ashland, OR (US)

( * ) Notice: Subject to any disclaimer, the term of this patent is extended or adjusted under 35 U.S.C. 154(b) by 0 days.

(21) Appl. No.: 13/949,396

(22) Filed: Jul. 24, 2013

(51) Int. Cl.
*F02B 19/16* (2006.01)
*F02B 19/14* (2006.01)

(52) U.S. Cl.
USPC ..... 123/305; 123/297

(58) Field of Classification Search
USPC ..... 123/305, 297, 298, 301, 306, 307, 308, 123/432, 256, 275; 239/558
See application file for complete search history.

(56) References Cited

U.S. PATENT DOCUMENTS

| | | | | |
|---|---|---|---|---|
| 2,382,151 | A * | 8/1945 | Harper, Jr. | 239/558 |
| 2,436,855 | A * | 3/1948 | Culbert | 123/275 |
| 2,731,956 | A * | 1/1956 | Schneider | 123/256 |
| 3,693,889 | A * | 9/1972 | Schuster | 239/533.6 |
| 5,514,314 | A | 5/1996 | McDougal | |
| 5,715,788 | A | 2/1998 | Tarr et al. | |
| 6,006,720 | A * | 12/1999 | Yanagihara et al. | 123/305 |
| H1890 | H * | 10/2000 | Parr et al. | 431/1 |
| 6,131,607 | A | 10/2000 | Cooke | |
| 6,340,015 | B1 | 1/2002 | Benedikt et al. | |
| 6,446,597 | B1 | 9/2002 | McAlister | |
| 6,544,347 | B2 | 4/2003 | Lucey, Jr. et al. | |
| 8,020,535 | B2 | 9/2011 | Law | |
| 8,104,444 | B2 * | 1/2012 | Schultz | 123/143 B |
| 8,359,836 | B2 | 1/2013 | Takahashi et al. | |
| 2003/0012985 | A1 | 1/2003 | McAlister | |
| 2003/0121998 | A1 | 7/2003 | Maier et al. | |
| 2007/0044755 | A1 | 3/2007 | Lehmann | |

(Continued)

FOREIGN PATENT DOCUMENTS

| | | |
|---|---|---|
| WO | 2011/025512 | 3/2011 |
| WO | 2011/028223 | 3/2011 |
| WO | 2012/099027 | 7/2012 |
| WO | 2012/103112 | 8/2012 |

OTHER PUBLICATIONS

Lucey Jr., G.K., "Vortex Ring Generator: Mechanical Engineering Design for 100-kpsi Operating Pressures", Army Research Laboratory, Jan. 2000.

(Continued)

*Primary Examiner* — Mahmoud Gimie
(74) *Attorney, Agent, or Firm* — Fish & Tsang LLP

(57) ABSTRACT

The inventive subject matter provides apparatus, systems and methods for treating and delivering a fuel to a combustion chamber of an engine in order to improve efficiency of the engine. In one aspect of the invention, a fuel injector that cooperates with an internal combustion engine to combust a first fuel to produce power is presented. The fuel injector includes a fuel inlet, a pre-conditioning vortex chamber, and an excitation chamber. The fuel injector includes a vortex chamber that conforms a pulsed amount of the first fuel to produce a vortex that includes a coherent dynamic pressure wave. The fuel injector also includes an excitation mechanism that at least partially ignites the fuel.

27 Claims, 7 Drawing Sheets

(56) References Cited

U.S. PATENT DOCUMENTS

| | | | | |
|---|---|---|---|---|
| 2008/0078182 | A1* | 4/2008 | Evulet | 60/776 |
| 2009/0317310 | A1* | 12/2009 | Coates et al. | 422/186.04 |
| 2010/0183993 | A1 | 7/2010 | McAlister | |
| 2011/0011370 | A1 | 1/2011 | Chien | |
| 2011/0042476 | A1 | 2/2011 | McAlister | |
| 2011/0048374 | A1 | 3/2011 | McAlister | |
| 2011/0125391 | A1 | 5/2011 | McAlister | |

OTHER PUBLICATIONS

Okoronkwo, C.A. et al., "The effect of electromagnetic flux density on the ionization and the combustion of fuel (An economy design project)", American Journal of Scientific and Industrial Research, 2010, vol. 1, No. 3, pp. 527-531.

"Spark Plugs", http://www.hho4free.com/sparkplugs.htm, screen capture Aug. 23, 2012.

* cited by examiner

FIG. 8B
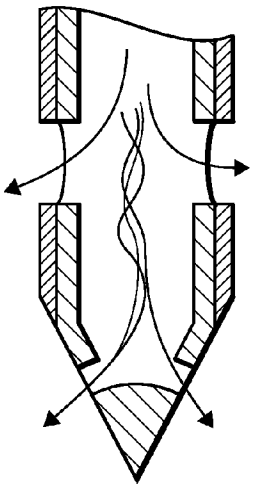
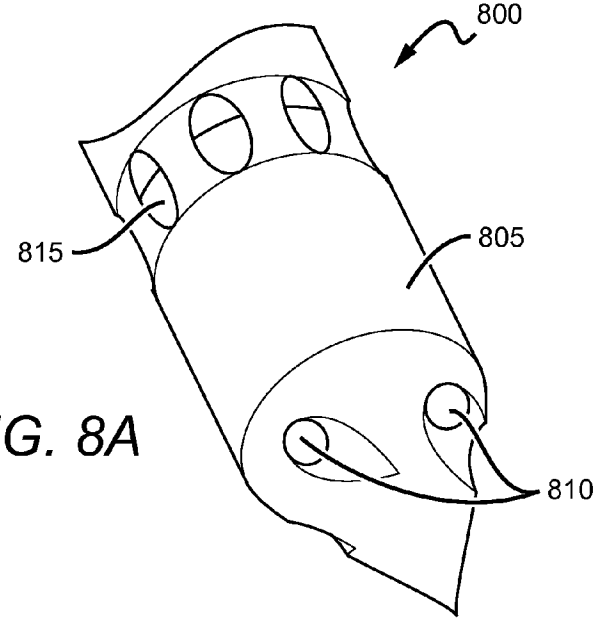
FIG. 8A
FIG. 7
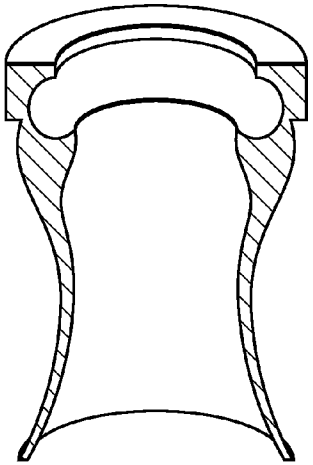

MULTI-FUEL PLASMA INJECTOR

FIELD OF THE INVENTION

The field of the invention is combustion engine systems, more specifically, a fuel injector for a combustion engine.

BACKGROUND

The following description includes information that may be useful in understanding the present invention. It is not an admission that any of the information provided herein is prior art or relevant to the presently claimed invention, or that any publication specifically or implicitly referenced is prior art.

Internal combustion engines have been around since the early nineteenth century. Even with the increasing popularity of hybrid and electric cars, internal combustion engines are still the main driving force of a majority of today's motor vehicles.

In an internal combustion engine (ICE) system, a mixture of fuel (e.g., gasoline or diesel) and an oxygen-containing gas (e.g., air) are injected into a combustion chamber. Upon ignition, the mixture combusts to produce gases (usually contains steam, carbon dioxide, and other chemicals) in very high temperature. As the gases expand due to high temperature, they generate a force that drives the moving parts (e.g., pistons) of the engine. In short, the ICE system produces power by transferring chemical energy that is stored in the fuel-air mixture to thermal and then mechanical energy.

However, even though ICEs have been in existence for a long period of time, they have never attained high efficiency levels. In fact, most ICEs in cars being produced today are only about 25% to 30% efficient (total thermal efficiency). Inefficiency of an ICE is usually caused by incomplete combustion of fuel, which also results in emission of harmful gases such as carbon dioxide and soot. As such, improvements to the ICE's efficiency would reduce both fuel consumption and air pollution.

Efforts have been made in the past to improve the efficiency of ICE systems. For example, International Patent Publication WO2011/028223 to McAlister entitled "Integrated Fuel Injectors and Igniters and Associated Methods of Use and Manufacture", filed Jul. 21, 2010, and U.S. Pat. No. 5,715,788 to Tarr et al. entitled "Integrated Fuel Injector and Ignitor Assembly", filed Jul. 29, 1996 disclose integrated injector/ignitors that provides efficient injection, ignition, and complete combustion of various types of fuels (e.g., natural gas fuel, etc.).

Other examples of fuel injectors or ignitors that aim at making more efficient fuel consumption in a combustion engine include:

- U.S. Patent Publication 2003/0121998 to Maier et al. entitled "Fuel Injection Valve", filed Nov. 12, 2001 discloses a fuel injector with a swirl disk located downstream from the valve seat, which imparts at least a portion of the fuel to flow in a swirl and
- U.S. Pat. No. 6,340,015 to Benedikt et al. entitled "Fuel Injection Valve with Integrated Spark Plug", filed Mar. 24, 1999 discloses a fuel injection value having ignition electrodes.

However, even with the techniques that are taught in the above-referenced literature, the efficiency of ICE has still yet to reach anything close to an optimal level. Thus, there is still a need to improve on existing ICE systems to further improve efficiency and reduce emission of harmful by-products.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

SUMMARY OF THE INVENTION

The inventive subject matter provides apparatus, systems and methods for treating and delivering a fuel to a combustion chamber of an engine in order to improve efficiency of the engine. In one aspect of the invention, a fuel injector cooperates with an internal combustion engine to combust a first fuel to produce power. The fuel injector includes a vortex chamber that conforms a pulsed amount of the first fuel to produce a vortex that includes a coherent dynamic pressure wave. The fuel injector also includes an excitation mechanism that at least partially ignites the fuel.

In some embodiments, the vortex chamber has an elliptical flow form. In some embodiments, the vortex chamber also has a surface topology comprising a pattern of features that induces the first fuel to flow in vortices.

The pattern of features can include features selected from the group of features including: bumps, dimples, cavities, ridges, grooves, and wedges. In some embodiments, the pattern of features has at least one feature with a depth of at least 0.1 millimeter (mm). In some embodiments, the pattern of features has at least one feature with a length of at least 0.2 mm. Preferably, the feature(s) has/have a length of between 0.2 mm and 30 mm. In addition, the pattern of features in some embodiments is configured to produce a rotating movement of the first fuel. In some embodiments, the surface topology includes a second pattern of features configured to produce a counter-rotating movement of the first fuel. Furthermore, the pattern of features in some embodiments is configured to produce a movement of the first fuel that resonates with the vortex.

In some embodiments, the vortex chamber also includes a flow guide that entrains the first fuel pulse to produce a coherent downstream flow pattern. In some of these embodiments, the coherent downstream flow pattern includes a coherent ring vortex, in which the concentration of fuel is higher in the center portion of the vortex than in the radial portion of the vortex.

In some embodiments, the excitation mechanism is positioned to excite the first fuel with an excitation chamber. The fuel injector in some embodiments also includes a vortex-inducing horn positioned at the upstream end of the excitation chamber, and a de Laval nozzle position at the downstream end of the vortex chamber.

In some embodiments, the excitation mechanism can include a radio frequency generator. In other embodiments, the excitation mechanism can include an ultrasonic atomizer. The ultrasonic atomizer can include a piezo-electric material. In some embodiments, the radio frequency generator has an output that is phase coupled with the output of the ultrasonic atomizer.

In some embodiments, the excitation chamber also includes a component that emits a high frequency radiation. In some of these embodiments, the high frequency radiation has a sufficient intensity to at least partially ionize a pulsed amount of a second fuel. Also, the excitation chamber of some embodiments can include an outer conductor and an inner conductor operable to produce a plasma from a pulsed amount of the second fuel.

The fuel injector of some embodiments can also include a dual actuating solenoid.

In another aspect of the invention, an internal combustion engine that includes a fuel injector having the capability of accepting more than one type of fuel is presented. In some embodiments, the fuel injector of the internal combustion engine has a vortex chamber. The vortex chamber is configured to receive a pulse of a first fuel through a first fuel inlet, and a pulse of a second fuel through a second fuel inlet. In some embodiments the first fuel has a different chemical composition from the second fuel, while in other embodiments, the first fuel has the same chemical composition as the second fuel.

In some embodiments, the first fuel enters the vortex chamber as an air/fuel mixture. The fuel injector of the internal combustion engine also has an excitation mechanism. The excitation mechanism is positioned to excite the second fuel with an excitation chamber. The excitation mechanism is also operable to use the second fuel to ignite the first fuel.

In some embodiments, the internal combustion engine also includes a combustion cylinder having a cylinder inlet. In some of these embodiments, the excitation chamber is positioned to provide a pulsed flame front to the cylinder inlet.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 7 is a schematic of a horn.

FIG. 8A is a schematic of a different valve needle guide.

FIG. 8B illustrates flow patterns of fuel within the valve needle guide.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The inventive subject matter provides apparatus, systems and methods for treating and delivering a fuel to a combustion chamber of an engine in order to improve efficiency of the engine. In one aspect of the invention, a fuel injector that cooperates with an internal combustion engine to combust a first fuel to produce power is presented.

Figure 1:
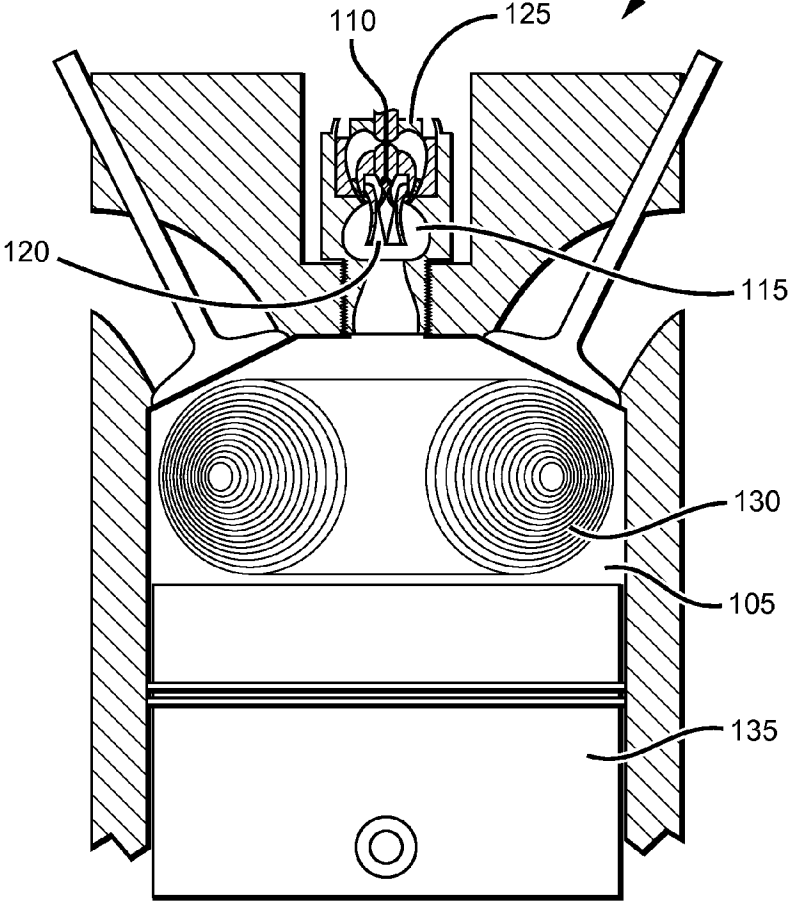
FIG. 1 is a schematic of a fuel injector.

FIG. 1 illustrates an example of such a fuel injector 100. In this figure, the fuel injector 100 is configured to deliver fuel into a combustion chamber 105 of an ICE. In some embodiments, the fuel injector 100 is configured to treat the fuel, and preferably turning a majority of the fuel into a plasma state, before delivering the fuel into the combustion chamber 105. The fuel injector 100 includes a fuel inlet 110, a pre-conditioning vortex chamber 115, and an excitation chamber 120.

The fuel inlet 110 is configured to receive a pulse amount of fuel from a fuel source such as a fuel tank and an air intake. In some embodiments, the fuel inlet 110 is configured to receive any of a diverse range of fuels, such as, but not limited to, gasoline, diesel, biofuels, ethanol, liquefied petroleum gas (LPG), and compressed natural gas (CNG). In some embodiments, the fuel is also mixed with air before entering into the vortex chamber 115. For simplicity, the air/fuel mixture will be referred to as fuel in the following description below.

After receiving the fuel from the fuel inlet 110, the fuel injector 100 conditions the fuel in the vortex chamber 115. In some embodiments, the vortex chamber 115 has an elliptical flow form that guides the fuel to flow into the combustion chamber 105 in vortices comprising coherent dynamic pressure wave. As shown in the figure, the fuel is directed to enter the combustion chamber 105 through a plasma field 130. The plasma field 130 in some embodiments transforms at least a portion of the fuel from a liquid state or a vapor state into a plasma state for more efficient combustion. Once inside the combustion chamber 105, the fuel injector 100 also includes a mechanism to ignite a least a portion of the fuel to initiate the combustion process, which transfers the chemical energy within the fuel into thermal energy. The resulting gases from the combustion process expands due to heat and forces the piston head 135 to move from a first position to a second position, which in turn runs the engine.

Figure 2:
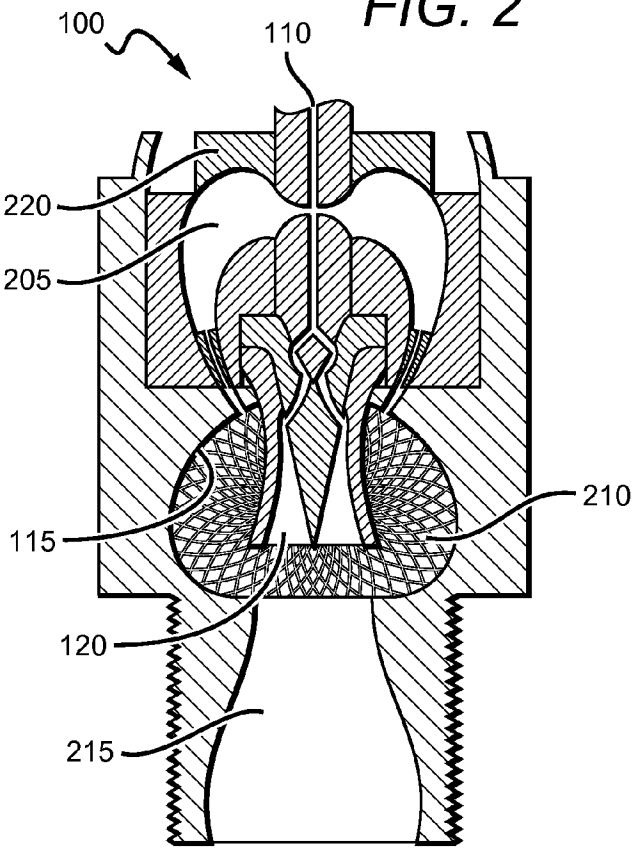
FIG. 2 illustrates another schematic of a fuel injector.

FIG. 2 illustrates the fuel injector 100 in more detail. Specifically, the fuel injector 100 is shown in this figure to include elliptical flow forms 205, 210, and 215. The elliptical flow forms assist in entraining the fuel to flow in the coherent dynamic pressure wave. In order to further guide the fuel to flow in vortices, the vortex chamber 115 of some embodiments also includes a flow guide. The flow guide is configured to entrain the fuel pulse to produce a coherent downstream flow pattern. In some of these embodiments, the coherent downstream flow pattern includes a coherent ring vortex, with the characteristics of having higher concentration of fuel in the center portion of the vortex than in the radial portion of the vortex. As depicted in this figure, fuel injector 100 also acts as a spark plug.

Figure 3A:
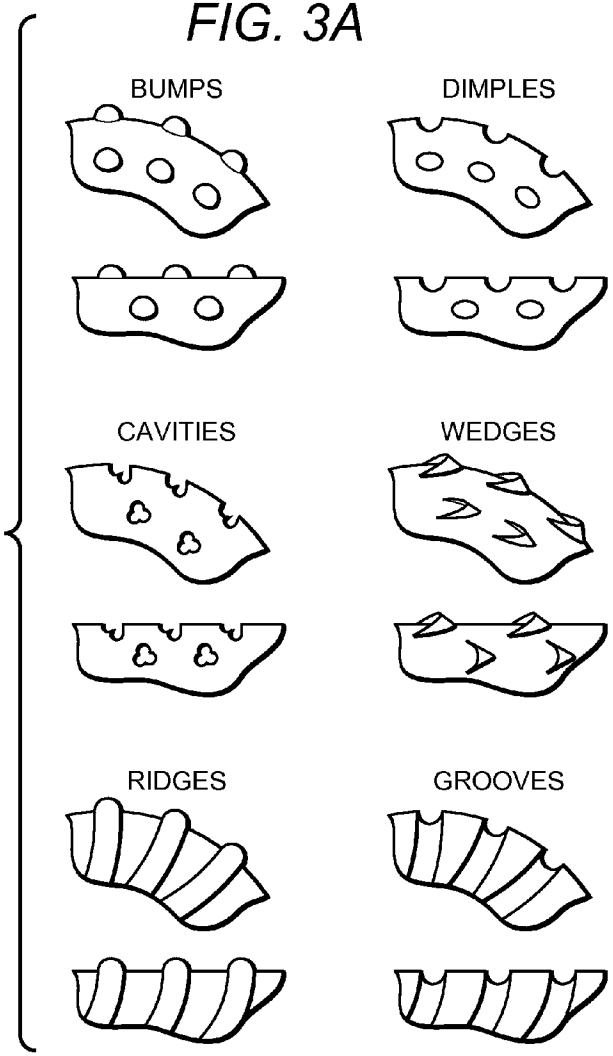
FIG. 3A illustrates example features that can be implemented within the surface topology of a vortex chamber.

To further entrain the fuel to flow in vortices, the interior wall of the vortex chamber 115 has a surface topology that includes a pattern of features (as shown as multiple diamond shaped patterns on the surface of the vortex chamber 115). These features can be of different shapes, lengths, and depths. In some embodiments, the pattern of features on the interior wall includes at least one of the following features: bumps, dimples, cavities, ridges, grooves, and wedges. FIG. 3A illustrates some examples of the features that can be included in the surface topology of the vortex chamber 115.

In some embodiments, the pattern of features on the interior wall of the vortex chamber includes at least one feature with a depth of at least 0.1 mm. In addition, the pattern of features on the interior wall preferably includes at least one feature with a length of at least 2 mm. Even more preferably, the pattern of features on the interior wall preferably includes at least one feature with a length of between 2 mm and 30 mm.

Figure 3B:
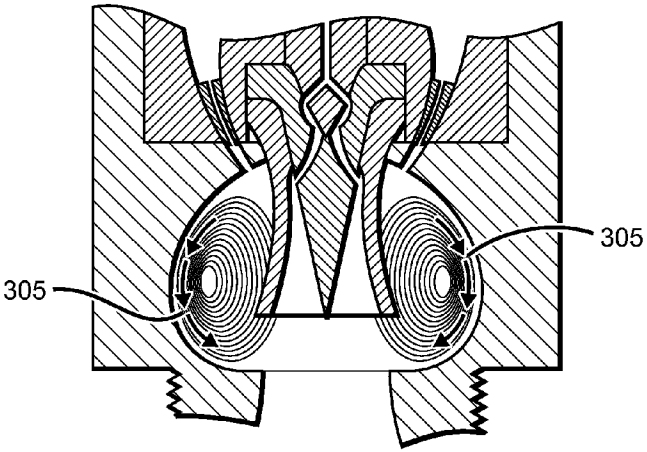
FIG. 3B illustrates counter-rotating fuel in a vortex chamber.
Figure 3C:
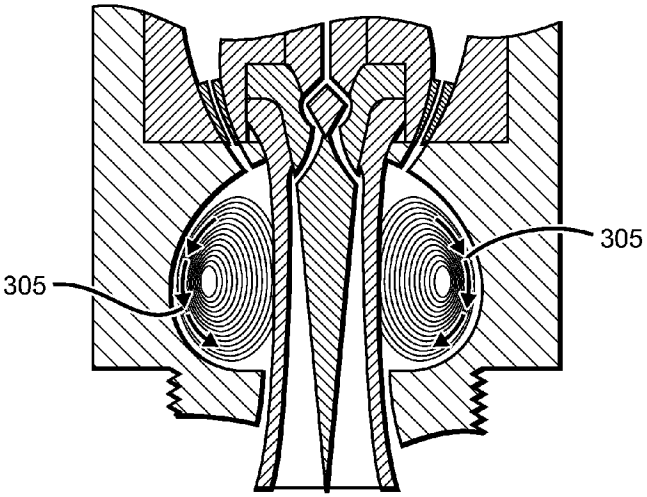
FIG. 3C also illustrates counter-rotating fuel in a vortex chamber.

The pattern of features in some embodiments work in concert to produce a rotating movement of the fuel. In some embodiments, the rotating movement is being produced such that it resonates with the vortices of the fuel. In addition, the surface topology of the vortex chamber 115 also includes a second pattern of features that is configured to produce a counter-rotating movement of the fuel, as shown by the arrows 305 in FIGS. 3B-3C.

The fuel injector includes a vortex chamber that conforms a pulsed amount of the first fuel to produce a vortex that includes a coherent dynamic pressure wave. The fuel injector also includes an excitation mechanism that at least partially ignites the fuel.

Referring back to FIG. 1, the fuel injector 100 also includes an excitation chamber 120. The excitation chamber 120 of some embodiments includes an excitation mechanism that is positioned to excite the fuel within the excitation chamber. To maintain the coherent vortex ring flow form of the fuel through the excitation chamber 120, the excitation chamber 120 of some embodiments includes a vortex-inducing horn that is positioned at the upstream end of the excitation chamber 120. The horn helps the fuel to maintain its vortex ring flow form through the excitation chamber 120. In some embodiments, the excitation chamber 120 also includes a de Laval nozzle positioned at the downstream end of the excitation chamber to speed up the fuel at the exit of the fuel injector 100 into the combustion chamber 105. More detailed information of the de Laval nozzle can be found in U.S. Pat. No. 8,359,836 to Takahashi entitled "Internal Combustion Engine, Vehicle, Marine Vessel, and Secondary Air Supply Method for Internal Combustion Engine", filed Jun. 15, 2009.

In some embodiments, the excitation mechanism is configured to excite the fuel and transform at least a portion of the fuel from a liquid/vapor state into a plasma state. In some embodiments, the excitation mechanism can include an ultrasonic atomizer and a radio frequency generator to atomize and excite the fuel. In some embodiments, the ultrasonic atomizer comprises a piezo-electric material. In some of these embodiments, the radio frequency generator has an output that is phase coupled with the output of the ultrasonic atomizer. In some embodiments, the fuel injector also includes an integrated coil to compress, contain, and accelerate the plasma dynamic.

It is noted that the piezo-electric material can be disposed at different locations within the fuel injector 100. In some embodiments, the piezo-electric material can be placed at a location within the fuel injector 100 to atomize the fuel prior to or upon delivery to either the vortex chamber 115 or the excitation chamber 120. In some embodiments, the piezo-electric material can act in concordance with the excitation mechanism.

Although the fuel injector 100 shown in FIG. 1 only has one fuel inlet 110, the fuel injector 100 in some other embodiments can include multiple fuel inlets (e.g., first fuel inlet, second fuel inlet, etc.) to receive a second fuel. In some of these embodiments, the fuel injector 100 is configured to receive the same type of fuel (fuels having identical chemical compositions) through the multiple inlets. Alternatively, the fuel injector 100 can be configured to receive two different types of fuel, such that the second fuel received through a second inlet has a different chemical composition than the fuel received through the fuel inlet 110.

In some embodiments, the excitation mechanism in the excitation chamber 120 is positioned to excite both the first and second types of fuel. In some of these embodiments, the excitation chamber also includes a component that emits a radio frequency radiation having a sufficient intensity to at least partially ionize a pulsed amount of the second fuel. Also, the excitation chamber of some embodiments can include an outer conductor and an inner conductor operable to produce a plasma from a pulsed amount of the second fuel. After turning the pulsed amount of the second fuel into a plasma state, the fuel injector 100 can ignite the second fuel, and then use the second fuel to ignite the first fuel.

To ignite the second and/or the first fuel, the excitation chamber 120 of some embodiments is positioned to provide a pulsed flame front to a cylinder inlet 140 of the combustion chamber 105.

As illustrated by the description above, the fuel injector that is contemplated herein entrains the fuel to flow in a coherent dynamic pressure wave flow form through an excitation chamber. The fuel is then excited by excitation mechanism before being delivered into the combustion chamber. The coherent dynamic pressure wave flow allows the fuel to turn into plasma state much more efficiently than traditional methods. It is also noted that the combination of the vortex chamber and the excitation mechanism within the fuel injector improves the efficiency of the ICE and reduces exhaust emissions.

Figure 4A:
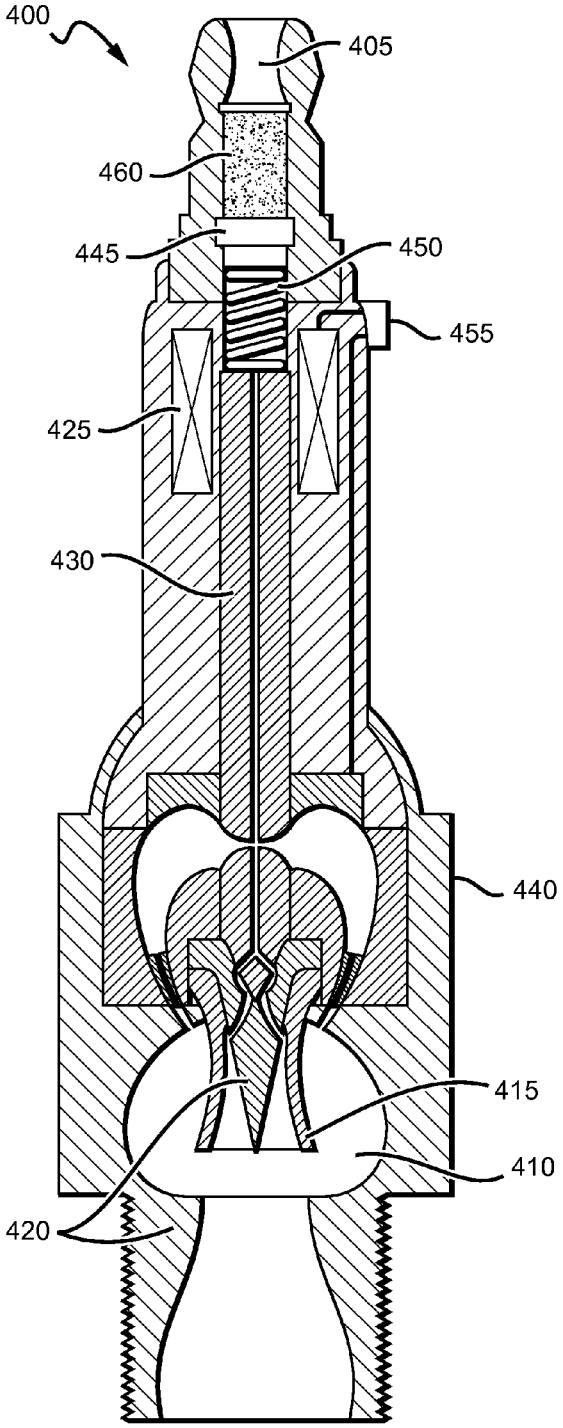
FIG. 4A illustrates a schematic of an alternative fuel injector.
Figure 4B:
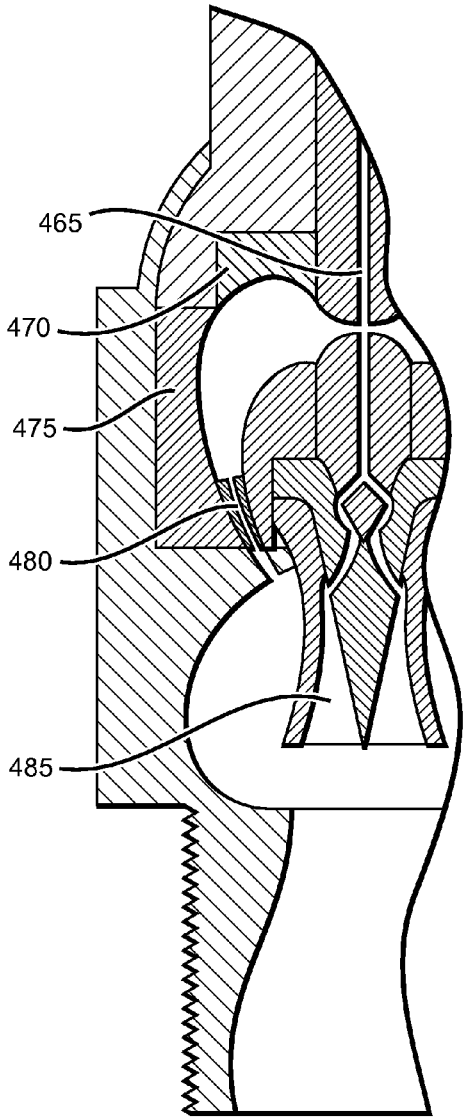
FIG. 4B illustrates an expanded view of a section of the fuel injector of FIG. 4A.

FIGS. 4A-4B illustrate a bisectional view of a fuel injector 400. The fuel injector 400 includes a fuel inlet 405 that leads a fuel into a vortex chamber 410, electrical connector 445, solenoid coil 425, valve needle 430, high voltage electrodes 420, horn 415, metal casing 440, a return spring 450, another electrical connector 455, a fuel filter 460, a valve needle bore 465, an ultrasonic atomizer 470, insulator 475, check valve 480, and an excitation chamber 485.

The vortex chamber 410 of some embodiments has an elliptical flow form and a surface topology on the interior of the chamber similar to the one described above by reference to FIGS. 1 and 2 for inducing the fuel to flow in vortices and coherent dynamic pressure waves. The surface of the interior wall of the vortex chamber 410 can also have a surface catalyst that is selected from the group of elements consisting of iron (Fe), titanium (Ti), nickel (Ni), palladium (Pd), platinum (Pt), Copper (Cu), Zinc (Zn), and Chromium (Cr).

The vortex chamber 410 is shown to include a horn 415 that further entrains the fuel to flow in vortices through the vortex chamber 410. In some embodiments, the horn 415 can include a material selected form this group: titanium (Ti), any ceramic material, quartz, and piezoelectric material. The horn 415 can also include a surface layer made of a material selected from this group: iron (Fe), titanium (Ti), nickel (Ni), palladium (Pd), platinum (Pt), Copper (Cu), Zinc (Zn), and Chromium (Cr). The body of the fuel injector 400 can be made of insulating material such as silicon or organic composite).

In the center of the vortex chamber 410 positioned a pair of high voltage electrodes 420 for disintegrating the fuel. The electrode can be made from a material selected from this group: iron (Fe), titanium (Ti), nickel (Ni), palladium (Pd), platinum (Pt), Copper (Cu), Zinc (Zn), Chromium (Cr), ferroelectric material for piezoelectric transformer effect. This group of materials also has the characteristics of allowing for vibratory and electrical resonance to increase produced voltage while reducing supplied voltage.

Figure 5B:
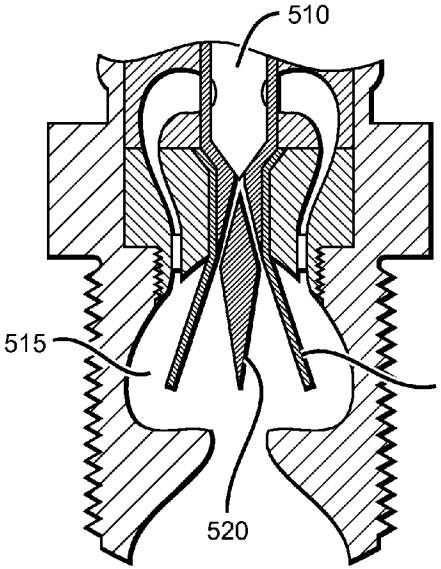
FIG. 5B illustrates an expanded view of a section of the fuel injector of FIG. 5A.
Figure 5A:
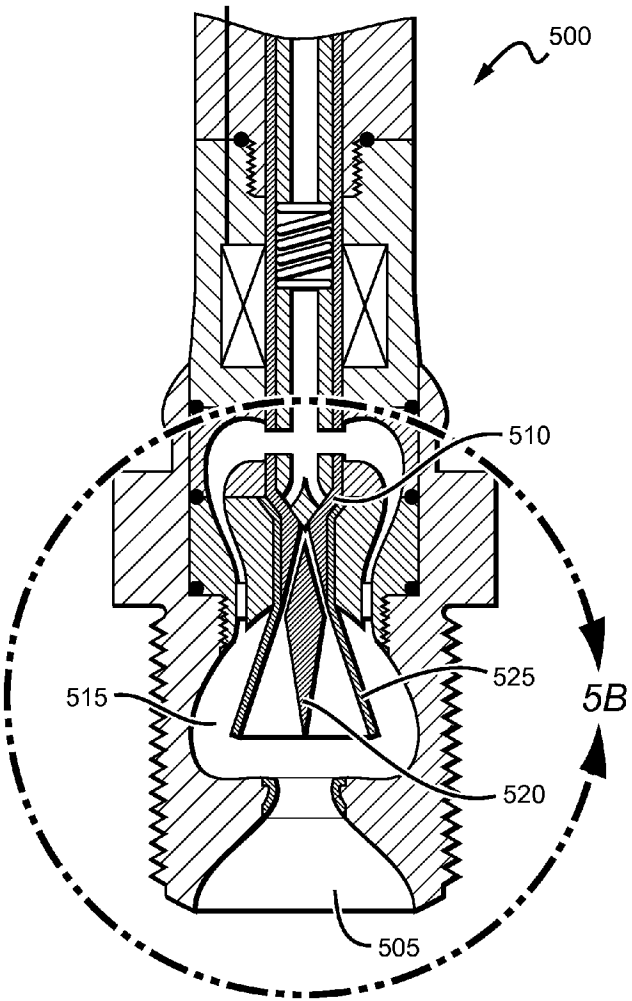
FIG. 5A illustrates a schematic of another alternative fuel injector.

FIG. 5A illustrates another embodiment of a fuel injector. The fuel injector 500 illustrated in FIG. 5A is different from the fuel injector 400 by the followings. First, the fuel injector 500 has a de Laval Nozzle 505 configured to release the fuel into the combustion chamber of an ICE. The fuel injector 500 also includes a valve needle guide 510 for guiding the fuel into the vortex chamber 515 in a coherent dynamic pressured wave (e.g., vortices). In addition, a center electrode 520 is shown to be positioned downstream of where the fuel comes out from the valve needle guide 510. The fuel injector 500 also includes a horn 525 for controlling the flow of the fuel within the vortex chamber 515.

FIG. 5B is an expanded view of a section of the fuel injector 500, which illustrates one possible arrangement of the valve needle guide, center electrode and horn within the fuel injector. As shown, the valve needle guide 510 is positioned immediately upstream of the vortex chamber 515. The downstream end of the valve needle guide 510 is also connected to the center electrode 520.

Figure 6:
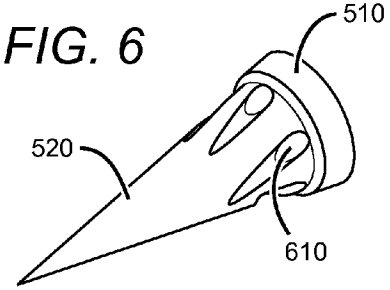
FIG. 6 is a schematic of a valve needle guide with a center electrode.

FIG. 6 illustrates a more detailed view of the downstream end of the valve needle guide 510 and the center electrode 520. In FIG. 6, the valve needle guide 510 is attached to the center electrode 520. The valve needle guide 510 includes several fuel swirl orifices 610. In this configuration, the fuel that is being sprayed out of the valve needle guide 510 through the fuel swirl orifices 610 will immediately come into contact or close proximity of the center electrode 520.

FIG. 7 illustrates an example horn that can be implemented in the vortex chamber of a fuel injector.

FIG. 8A illustrates an alternative embodiment of the valve needle guide. In FIG. 8A, valve needle guide 800 includes a rotatable valve needle 805 that is capable of turning on its vertical axis. The valve needle guide 800 also includes swirl orifices 810 that are configured to send fuel in a trajectory that compliments the valve seat. The valve needle guide 800 includes one or more hollow bores 815 (can be vertical, horizontal, or diagonal to accommodate fuel flow) for letting fuel exit the valve needle guide into the vortex chamber. FIG. 8B illustrates the flow of fuel within the valve needle guide 800.

Figure 9C:
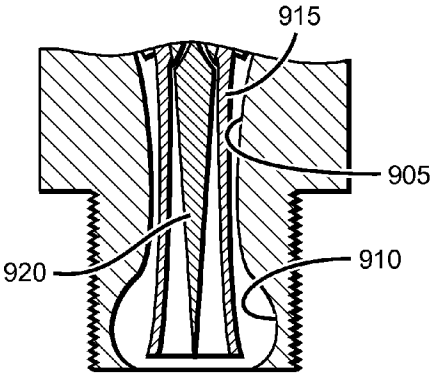
FIG. 9C illustrates yet another implementation of elliptical flow form of a vortex chamber, the excitation chamber, horn, and electrode assembly within a fuel injector.
Figure 9B:
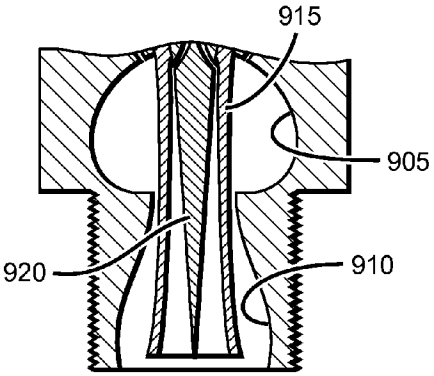
FIG. 9B illustrates another implementation of elliptical flow form of a vortex chamber, the excitation chamber, horn, and electrode assembly within a fuel injector.
Figure 9A:
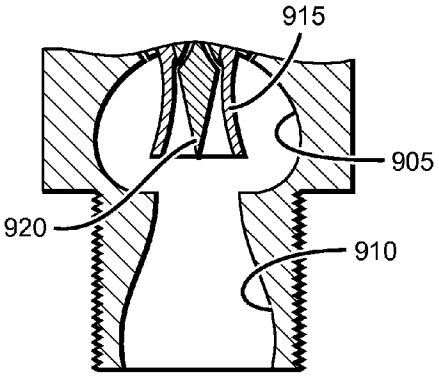
FIG. 9A illustrates an implementation of elliptical flow form of a vortex chamber, the excitation chamber, horn, and electrode assembly within a fuel injector.

FIGS. 9A-9C illustrate three different implementations of the elliptical flow form of the vortex chamber 905, the excitation chamber 910, the horn 915, and electrode assembly 920 within a fuel injector of some embodiments.

Figure 10B:
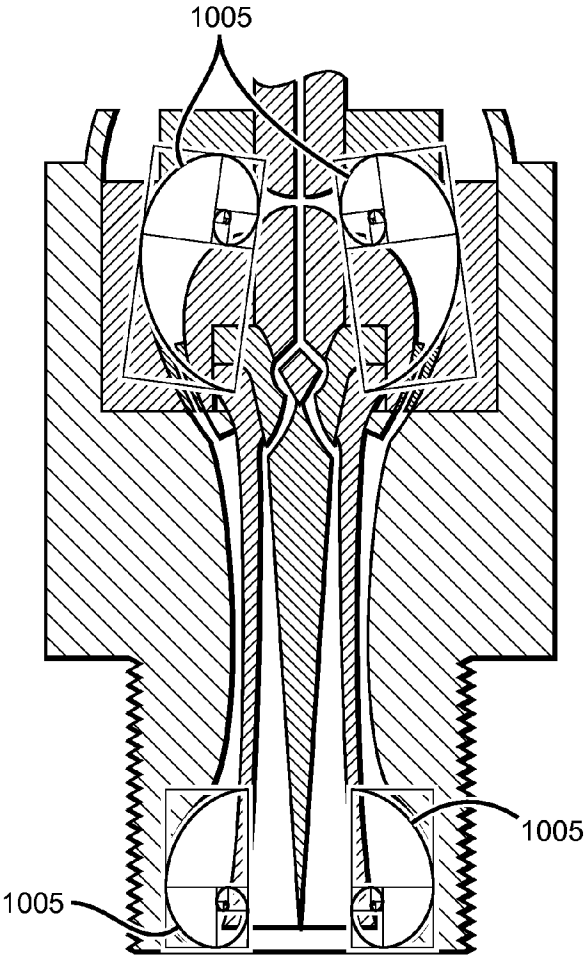
FIG. 10B illustrates an elliptical flow form in another fuel injector that follows the phi-based ratio.
Figure 10A:
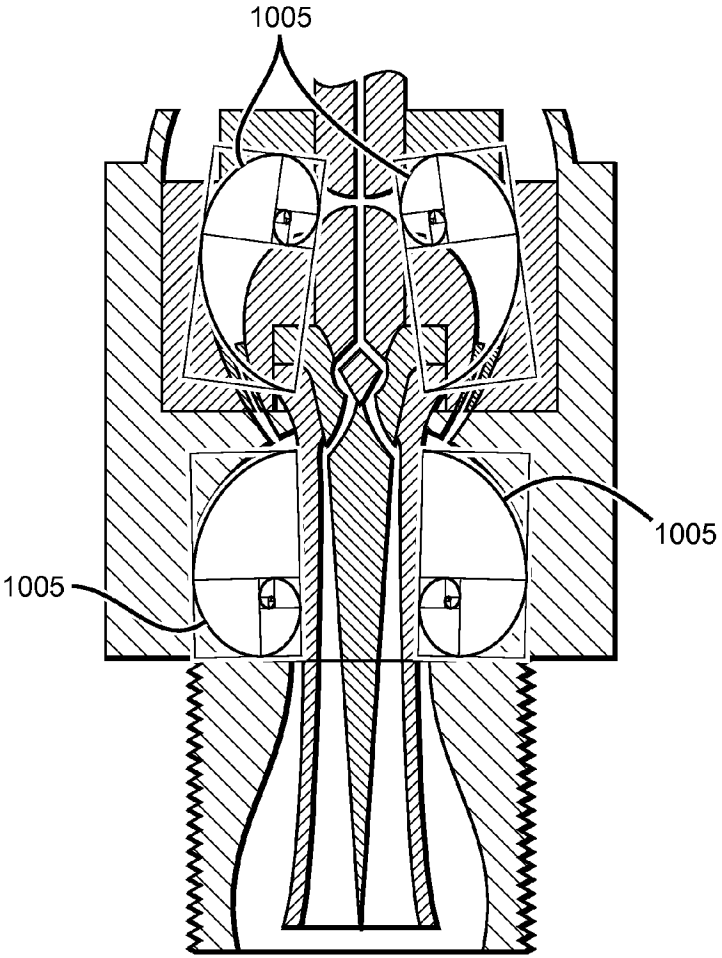
FIG. 10A illustrates an elliptical flow form in a fuel injector that follows the phi-based ratio.

In some embodiments, to further entrain the fuel/air mixture to flow in the coherent dynamic pressure wave, the elliptical flow forms in the fuel injector conform to a phi-based ratio. FIGS. 10A-10B illustrates two different fuel injectors having elliptical flow forms 1005 that follow the phi-based ratio.

Figure 11B:
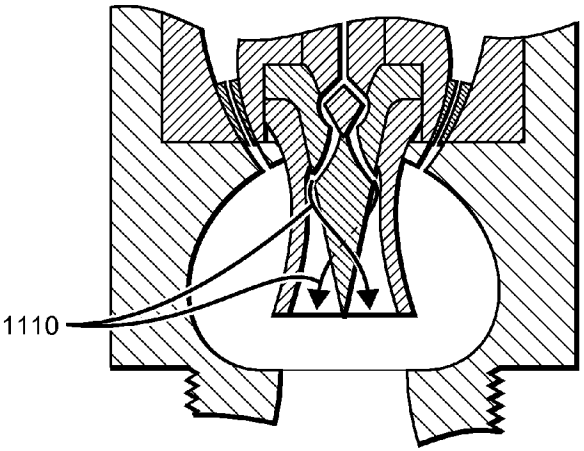
FIG. 11B illustrates another possible pathway for guiding fuel through the fuel injector of FIG. 11A.
Figure 11A:
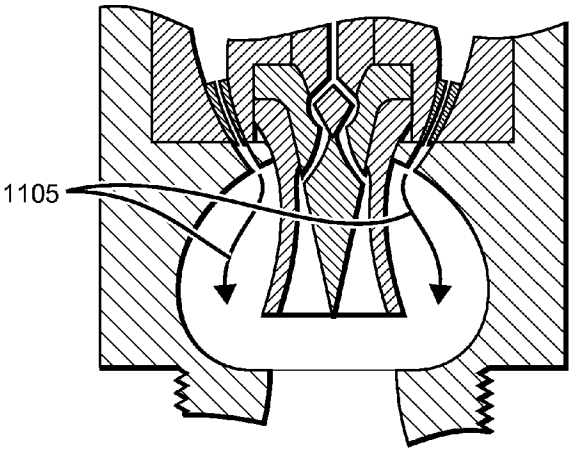
FIG. 11A illustrates a possible pathway for guiding fuel through the fuel injector.

As mentioned above, the fuel injector of some embodiments includes multiple fuel inlets to receive more than one fuel (or more than one type of fuel). In these embodiments, the fuel injector provides different paths for the different fuel to enter into the vortex chamber of the fuel injector. FIGS. 11A-11B illustrates a first path 1105 for a first fuel to enter into the vortex chamber and a second path 1110 for a second fuel to enter into the vortex chamber of the fuel injector.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A fuel injector that cooperates with an internal combustion engine to combust a first fuel to produce power, comprising:

a vortex chamber having a surface topology that conforms a pulsed amount of the first fuel to a vortex comprising a coherent dynamic pressure wave, wherein the surface topology comprises a pattern of features including at least one of bumps, dimples, cavities, ridges, grooves, and wedges; and an excitation mechanism that at least partially ignites the fuel.

2. The fuel injector of claim 1, wherein the vortex chamber has an elliptical flow form.

3. The fuel injector of claim 1, wherein the pattern of features has at least one feature with a depth of at least 0.1 mm.

4. The fuel injector of claim 1, wherein the pattern of features has at least one feature with a length of at least 0.2 mm.

5. The fuel injector of claim 1, wherein the pattern of features is configured to produce a rotating movement of the first fuel.

6. The fuel injector of claim 5, wherein surface topology includes a second pattern of the features configured to produce a counter-rotating movement of the first fuel.

7. The fuel injector of claim 3, wherein the pattern of features is configured to produce a resonance within the vortex of the first fuel.

8. The fuel injector of claim 1 wherein the vortex chamber comprises a flow guide that entrains the first fuel pulse to produce a coherent downstream flow pattern.

9. The fuel injector of claim 8, wherein the downstream flow pattern comprises a coherent ring vortex.

10. The fuel injector of claim 9, wherein the coherent ring vortex has a higher concentration of fuel in a center portion of the vortex than in a radial portion of the vortex.

11. The fuel injector of claim 1, wherein the excitation mechanism is positioned to excite the first fuel with an excitation chamber, and further comprising a vortex-inducing horn positioned at an upstream end of the excitation chamber.

12. The fuel injector of claim 1, further comprising a de Laval nozzle positioned at a downstream end of the vortex chamber.

13. The fuel injector of claim 1, wherein the excitation mechanism is positioned to excite the first fuel within an excitation chamber.

14. The fuel injector of claim 1, wherein the excitation mechanism comprises a radio frequency generator.

15. The fuel injector of claim 1, wherein the excitation mechanism comprises an ultrasonic atomizer.

16. The fuel injector of claim 15, wherein the ultrasonic atomizer comprises a piezo-electric material.

17. The fuel injector of claim 15, wherein the excitation mechanism comprises a radio frequency generator having an output that is phase coupled with an output of the ultrasonic atomizer.

18. The fuel injector of claim 1, wherein the excitation mechanism is positioned to excite the first fuel with an excitation chamber, and wherein the excitation chamber includes a component that emits a radio frequency radiation.

19. The fuel injector of claim 18, wherein the radio frequency radiation has a sufficient intensity to at least partially ionize a pulsed amount of a second fuel.

20. The fuel injector of claim 18, wherein the excitation chamber has an outer conductor and an inner conductor operable to produce a plasma from a pulsed amount of a second fuel.

21. The fuel injector of claim 1, further comprising a dual actuating solenoid.

22. An internal combustion engine comprising the fuel injector of claim 1, wherein the vortex chamber is configured to receive the pulse of a first fuel through a first fuel inlet, and a pulse of a second fuel through a second fuel inlet.

23. The internal combustion engine of claim 22, wherein the first fuel has a different chemical composition from the second fuel.

24. The internal combustion engine of claim 22, wherein the first fuel has the same chemical composition as the second fuel.

25. The internal combustion engine of claim 22, wherein the first fuel enters the vortex chamber as an air/fuel mixture.

26. The internal combustion engine of claim 25, wherein the excitation mechanism is positioned to excite the second fuel with an excitation chamber, and is operable to use the second fuel to ignite the first fuel.

27. The internal combustion engine of claim 22, further comprising a combustion cylinder having a cylinder inlet, and wherein the excitation chamber is positioned to provide a pulsed flame front to the cylinder inlet.

* * * * *

UNITED STATES PATENT AND TRADEMARK OFFICE

CERTIFICATE OF CORRECTION

PATENT NO. : 8,757,129 B1
APPLICATION NO. : 13/949396
DATED : June 24, 2014
INVENTOR(S) : Garrett Hill, Scott Lazar and Dustin Stonehouse It is certified that error appears in the above-identified patent and that said Letters Patent is hereby corrected as shown below:

In the Claims

Column 9, please replace claim 7:

7. The fuel injector of claim 3, wherein the pattern of features is configured to produce a resonance within the vortex of the first fuel.

with:

7. The fuel injector of claim 1, wherein the pattern of features is configured to produce a resonance within the vortex of the first fuel.

Signed and Sealed this
Third Day of March, 2015

Michelle K. Lee

Michelle K. Lee
*Deputy Director of the United States Patent and Trademark Office*